US006159133A

United States Patent [19]

Shugg

[11] Patent Number: 6,159,133

[45] Date of Patent: Dec. 12, 2000

[54] SEAT MOUNTED WORKOUT STATION SYSTEM

[76] Inventor: Robert C. Shugg, 3530 Damien SP 267, La Verne, Calif. 91750

[21] Appl. No.: 09/262,198

[22] Filed: Mar. 4, 1999

[51] Int. Cl.[7] ..... A63B 21/00

[52] U.S. Cl. ..... 482/130; 482/121; 482/142

[58] Field of Search ..... 482/130, 142, 482/121, 907, 904, 129

[56] References Cited

U.S. PATENT DOCUMENTS

| | | | |
|---|---|---|---|
| 4,913,423 | 4/1990 | Farran et al. | 482/130 |
| 4,921,247 | 5/1990 | Sterling | 482/130 |
| 5,090,694 | 2/1992 | Pauls et al. | 482/130 |
| 5,242,347 | 9/1993 | Keeton | 482/102 |
| 5,324,243 | 6/1994 | Wilkinson | 482/92 |
| 5,899,836 | 5/1999 | Chen | 482/92 |

*Primary Examiner*—Jerome W. Donnelly

[57] ABSTRACT

A seat mounted workout station system is provided including a seating assembly having a seat portion and a back portion. Also included is a frame mounted on a rear surface of the back portion of the seating assembly. Next provided is a plurality of tension members connected to the frame and further connected to cables which are routed through the frame via pulleys. Hand grips are connected to the cables for being gripped by a user.

8 Claims, 3 Drawing Sheets

SEAT MOUNTED WORKOUT STATION SYSTEM

BACKGROUND OF THE INVENTION

1. Field of the Invention

The present invention relates to a seat mounted workout station system and more particularly pertains to exercising from a sitting position through various motions.

2. Description of the Prior Art

The use of workout equipment of known designs and configurations is known in the prior art. More specifically, workout equipment of known designs and configurations heretofore devised and utilized for the purpose of exercising through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,234,394 to Wilkinson discloses a Universal Portable Exercise Apparatus Adaptable to Fit a Chair. U.S. Pat. No. 5,090,694 to Pauls et al. discloses a Combination Chair and Exercise Unit. U.S. Pat. No. 4,921,247 to Sterling discloses an Exercise Chair. U.S. Pat. No. 5,362,296 to Wang et al. discloses a chair Mounting Exercising Unit. United States Patent Number to Wu discloses a Magnetically Controlled Exerciser for Exercising Arms. Lastly, U.S. Pat. No. Des. 289,190 to Brentham discloses a Physical Exercise Chair.

In this respect, the seat mounted workout station system according to the present invention substantially departs from the conventional concepts and designs of the prior art, and in doing so provides an apparatus primarily developed for the purpose of exercising from a sitting position through various motions.

Therefore, it can be appreciated that there exists a continuing need for a new and improved seat mounted workout station system which cad be used for exercising from a sitting position through various motions. In this regard, the present invention substantially fulfills this need.

SUMMARY OF THE INVENTION

In view of the foregoing disadvantages inherent in the known types of workout equipment of known designs and configurations now present in the prior art, the present invention provides an improved seat mounted workout station system. As such, the general purpose of the present invention, which will be described subsequently in greater detail, is to provide a new and improved seat mounted workout station system and method which has all the advantages of the prior art and none of the disadvantages.

To attain this, the present invention essentially comprises a new and improved seat mounted workout station system for exercising from a sitting position through various motions includes a seating assembly which has a generally vertically extending back portion. A seat portion is coupled to the back portion adjacent a lower extent thereof and a head portion is coupled to the back portion at the top thereof. Also provided are a plurality of springs and pulleys positioned within the back portion and including two interior cables and pulleys and springs which are coupled internally to a lower base of the back portion and primary hand grips adjacent to the chest of a user. The back portion also includes two outer cables, pulleys and springs which are coupled interially to an upper base of the back portion and secondary hand grips adjacent to the legs of the user. Two intermediate cables, pulleys and springs are coupled interially to an intermediate base of the back portion and tertiary hand grips coupled adjacent to the head of a user. Lastly provided is a strap which has free ends couplable to the primary hand grips for being moved in response to the forward motion of a chest of a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved seat mounted workout station system which has all of the advantages of the prior art workout equipment of known designs and configurations and none of the disadvantages.

It is another object of the present invention to provide a new and improved seat mounted workout station system which may be easily and efficiently manufactured and marketed.

It is further object of the present invention to provide a new and improved seat mounted workout station system which is of durable and reliable constructions.

An even further object of the present invention is to provide a new and improved seat mounted workout station system which is susceptible of a low cost of manufacture with regard to both materials and labor, and which accordingly is then susceptible of low prices of sale to the consuming public, thereby making such seat mounted workout station system economically available to the buying public.

Even still another object of the present invention is to provide a seat mounted workout station system for exercising from a sitting position through various motions.

Lastly, it is an object of the present invention to provide a seat mounted workout station system including a seating assembly having a seat portion and a back portion. Also included is a frame mounted on a rear surface of the back portion of the seating assembly. Next provided is a plurality of tension members connected to the frame and further connected to cables which are routed through the frame via pulleys. Hand grips are connected to the cables for being gripped by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
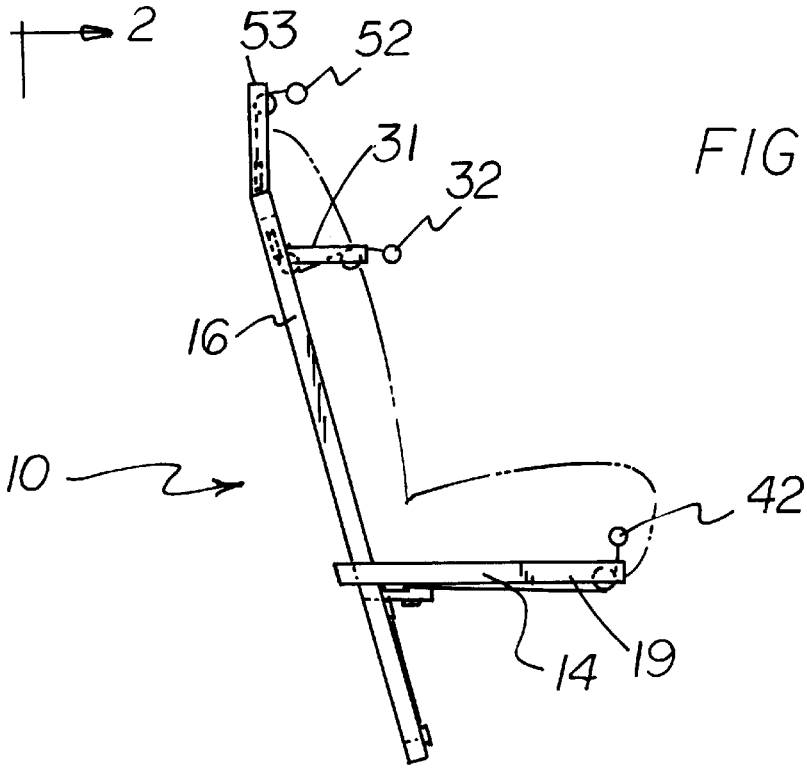
FIG. 1 is a side elevational view of the preferred embodiment of the seat mounted workout station system constructed in accordance with the principles of the present invention.
Figure 2:
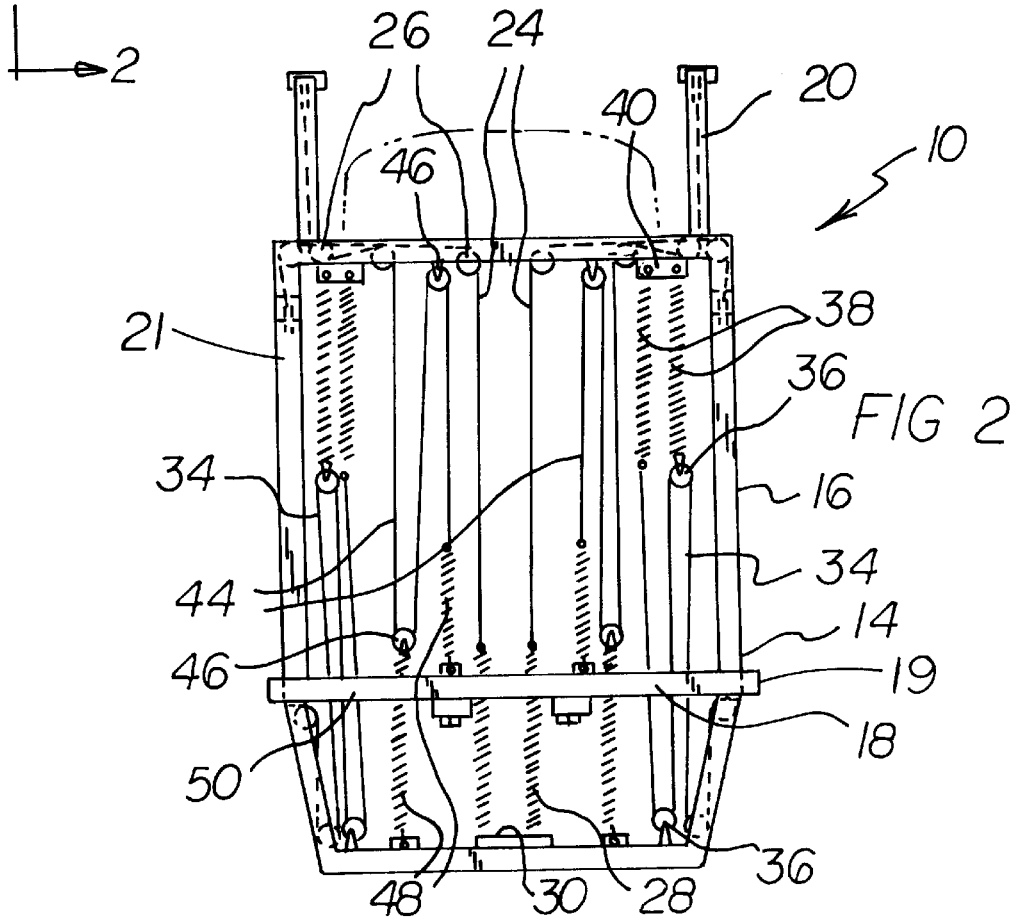
FIG. 2 is a rear elevational view of the seat taken at line 2—2 of FIG. 1.
Figure 3:
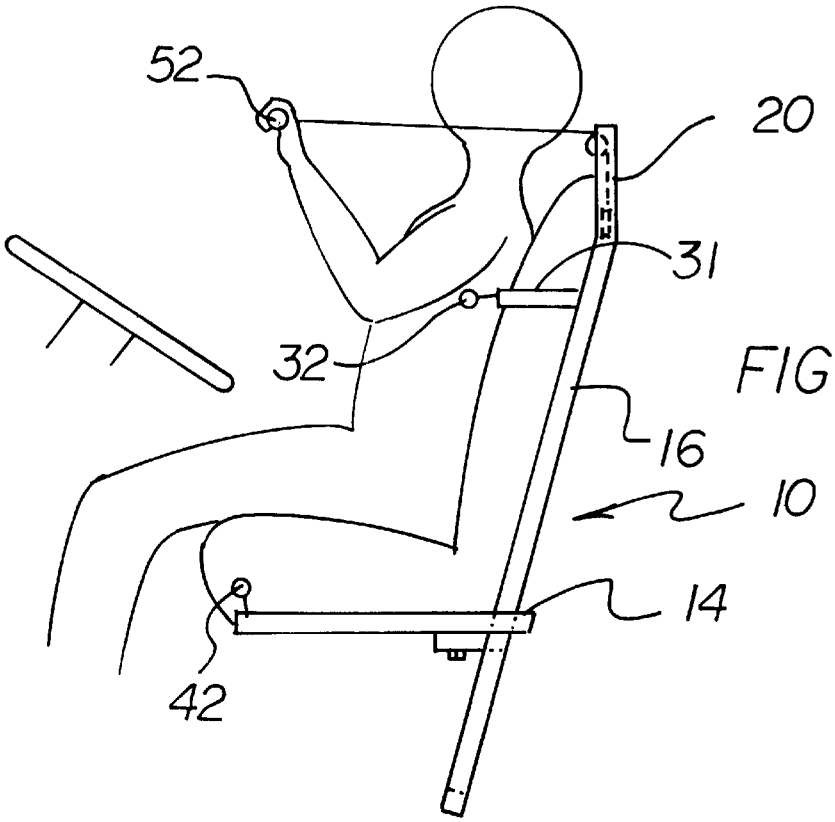
FIG. 3 is a schematic illustration of a person utilizing the system of the prior Figure by pulling grips in the head region.
Figure 4:
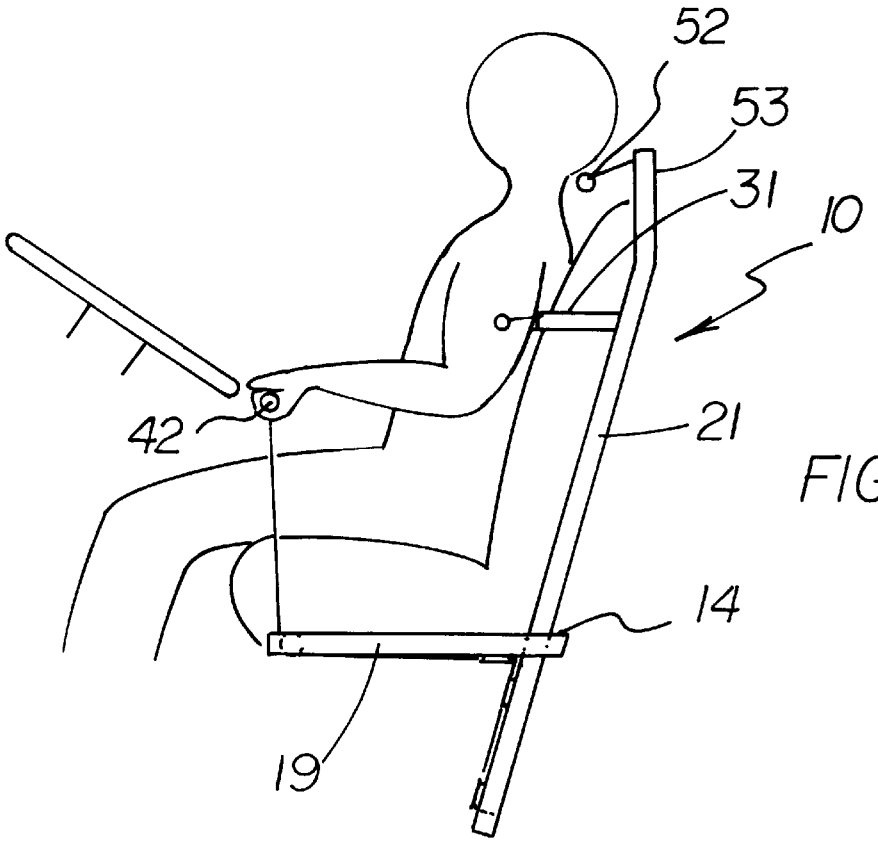
FIG. 4 is a schematic illustration of a person utilizing the system of the prior Figure by pulling grips in the legs region.
Figure 5:
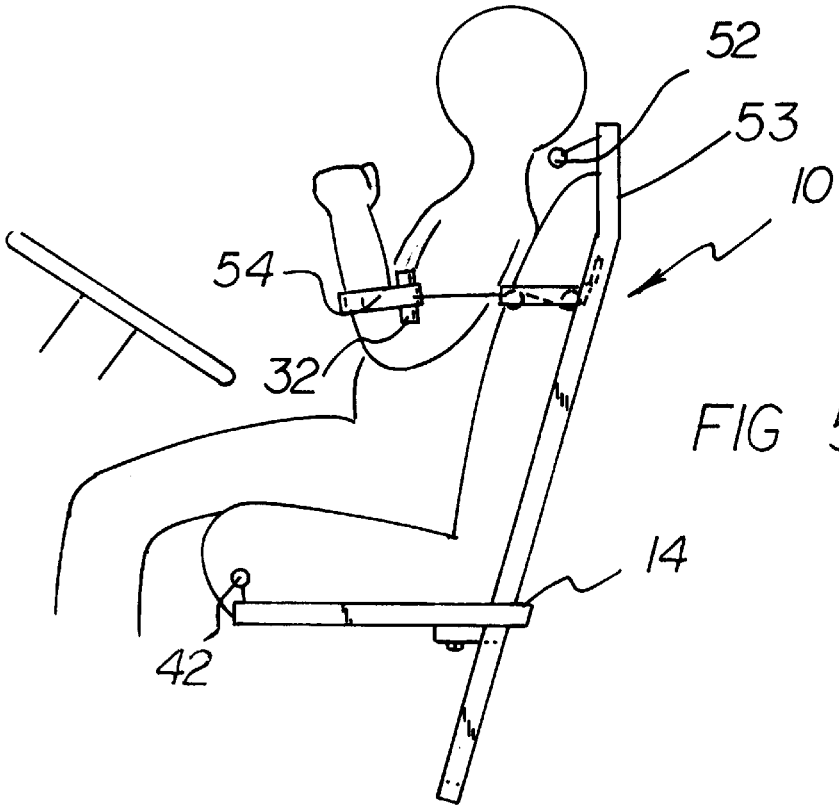
FIG. 5 is a schematic illustration of a person utilizing the system of the prior Figure by pulling grips in the chest region.
Figure 6:
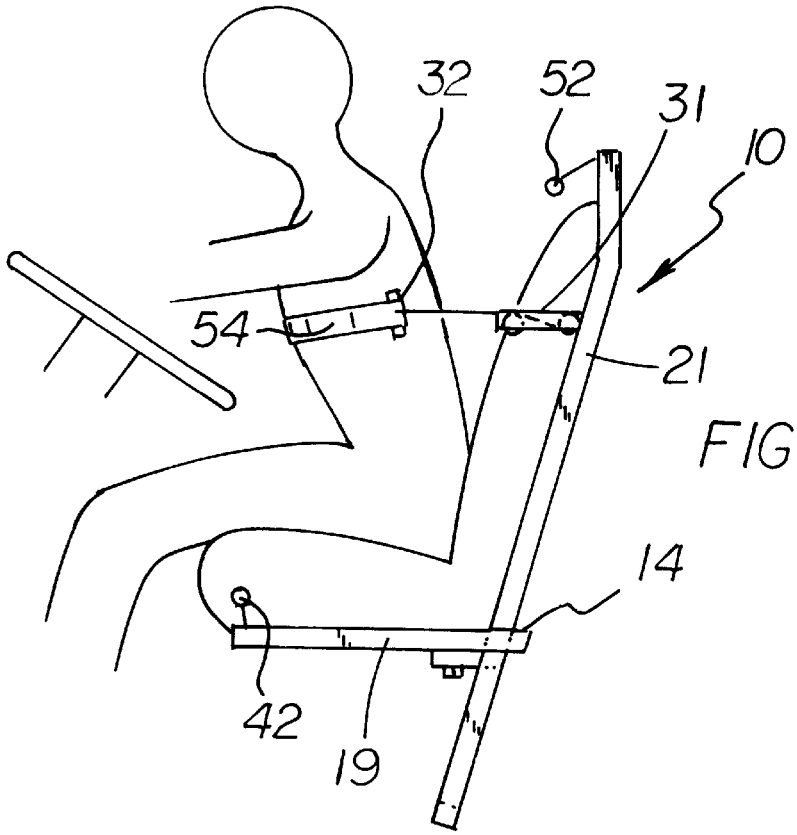
FIG. 6 is a view similar to FIG. 5 but illustrating the forward motion of a user.

With reference now to the drawings, and in particular to FIG. 1 thereof, the preferred embodiment of the new and improved seat mounted workout station system embodying the principles and concepts of the present invention and generally designated by the reference numeral 10 will be described.

The present invention, the seat mounted workout station system 10 is comprised of a plurality of components. Such components are individually configured and correlated with respect to each other so as to attain the desired objective.

More specifically, the new and improved seat mounted workout station system for exercising from a sitting position through various motions includes a seating assembly 14 which has a generally vertically extending back portion 16. A seat portion 18 is coupled to the back portion adjacent a lower extent thereof and a head portion 20 is coupled to the back portion at the top thereof. The seat portion preferably has a rectangular support assembly 19 mounted thereunder. The back portion preferably has a rectangular frame 21 mounted thereon which resides in a slightly angled plane. The frame has a width equal to that of the back portion and further extends from a point spaced from the head portion to a point below the seat portion.

Also provided are a plurality of cables, springs and pulleys positioned within the back portion. Such cables, springs and pulleys include two interior cables 24, pulleys 26 and springs 28 which are coupled internally to a lower base 30 of the frame of the back portion and primary hand grips 32 adjacent to the chest of a user. The primary hand grips preferably rest on a pair of primary hand grip arms 31 which are mounted to sides of the back portion adjacent to the head portion. The arms 31 preferably extend forward along an axis which is normal to a plane in which the back portion resides. The interior cables are preferably routed through the frame and to the arms via pulleys.

The back portion also includes two outer cables 34, pulleys 36 and springs 38 which are coupled interially to an upper base,40 of the frame of the back portion. Secondary hand grips 42 are positioned at outboard ends of the support assembly 19 of the seat portion adjacent to the legs of the user. The two outer cables each preferably include a spring mounted to the upper base which is coupled to a cable that is routed through a pulley mounted on the lower base. Thereafter, the cable is routed through a pulley coupled to another spring depending from the upper base. The cable is then are routed through the support assembly of the seat portion for coupling with the secondary hand grips.

Two intermediate cables 44, pulleys 46 and springs 48 are coupled interially to an intermediate base 50 of the back portion. Tertiary hand grips 52 are coupled adjacent to the head of a user. It should be noted that each of the hand grips have a cylindrical configuration. At rest, the tertiary hand grips preferably rest on tertiary hand grip arms 53 coupled to ends of the upper base and extending vertically therefrom. The two intermediate cables each preferably include a spring mounted to the intermediate base which is coupled to a cable that is routed through a pulley mounted on the upper base. Thereafter, the cable is routed through a pulley coupled to another spring connected to the lower base. The cable is then are routed through the frame and tertiary hand grip arms for coupling with the tertiary hand grips.

Lastly provided is at least one padded strap 54 which has free ends couplable to the primary hand grips for being moved in response to the forward motion of a chest of a user. To accomplish this, the strap has a pair of ends with holes therein for receiving the secondary hand grips.

As described hereinabove, the system of the present invention is a multi-purpose exercise gym that can be mounted behind the driver's seat in a tractor trailer truck. The system consists of a 30 inch high by 21 inch high by 23 inch wide frame that is produced from 1 inch square tubular steel. The frame bolts to the seat in a tractor trailer truck or similar vehicle and has three hand grips on each side for a user to hold while exercising. A first set of handles are located midway up the back of the frame so that they are approximately even with the driver's shoulders. A second set of hand grips is located on horizontal frame members of the support assembly that position the handles at the front corners of the seat. The third set of handles are located at the top of the frame so that they are positioned over the driver's head. Each handle is produced from steel tubing or molded from plastic. The handles are connected to lengths of stainless steel cable that runs through a series of pulleys and connect to springs or hydraulic cylinders mounted on the back of the frame so that the springs or cylinders stretch as the driver pulls on the handles. A set of padded springs slip over the handles and fasten around a driver's arms are also included.

The appealing features of the present system are its ability to help an individual tone and strengthen his or her muscles and fight fatigue.

The present system is designed to provide a multi-purpose exercise machine that is attached to the driver's seat in the cab or a truck or a motor home. This allows a driver to receive a workout before he starts his day, when he is finished driving for the day, or while his is driving. The driver simply sits in the seat, holds a hand grip in one hand and pulls on the hand grip. As the driver pulls on a hand grip, a cable connected to the hand grip stretches a spring. Overcoming the resistance provided by the spring tones and strengthens the muscles being used, and the driver can perform six different exercises with each arm to provide a complete upper body workout. Regular workouts could also increase a driver's safety by helping to prevent him or her from falling asleep while driving.

The present system is easy to install and does not get in the way when not in use. The frame fits flat against the back of a seat and is easily attached to virtually any seat. The handles are positioned within easy reach so that a driver does not take his eyes off the road, and the driver can vary the number of repetitions he performs to fit his strength or fitness level. The system also works the arms independently so that a driver could keep one hand on the steering wheel while he exercises.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A seat mounted workout station system for exercising from a sitting position through various motions comprising:

a seating assembly having a generally vertically extending back portion with a forward support surface for supporting a user of the seating assembly, a seat portion coupled to the back portion adjacent a lower extent thereof with an upward support surface for supporting the user of the seating assembly, the back portion having a head section formed at an upper end of the back portion a frame supporting the back and seat portions of the seating assembly, the frame including a back frame being positioned behind the back portion of the seating assembly a seat frame being positioned below the seat portion of the seating assembly, and a pair of frame extensions extending upwardly from an upper end of the back frame;

a pair of primary hand grips mounted on the back frame at a position adapted to be located adjacent to the chest of the user supported by the back portion of the seating assembly, and a pair of primary tensioning assemblies, each primary tensioning assembly applying tension to one of the primary hand grips to resist pulling of the primary hand grip in a direction away from the back frame, each of the primary tensioning assemblies being mounted on the back frame behind the seat portion of the seating assembly, each of the primary tensioning assemblies comprising an outer cable, a pair of pulleys, and a pair of springs being coupled to the back frame;

a pair of secondary hand grips mounted on the seat frame at a position adapted to be located adjacent to the legs of the user supported by the seat portion of the seating assembly, and a pair of secondary tensioning assemblies, each secondary tensioning assembly applying tension to one of the secondary hand grips to resist pulling of the secondary hand grip in a direction away from the back frame, each of the secondary tensioning assemblies being mounted on the back frame behind the seat portion of the seating assembly, each of the secondary tensioning assemblies comprising an intermediate cable, a pair of pulleys, and a pair of springs coupled to the back frame;

a pair of tertiary hand grips mounted on the frame extensions of the back frame at a position adapted to be located adjacent to the head of the user supported by the back portion of the seating assembly, the tertiary hand grips being mounted above the primary hand grips on the frame extensions of the back frame, and a pair of tertiary tensioning assemblies, each tertiary tensioning assembly applying tension to one of the tertiary hand grips to resist pulling of the tertiary hand grip in a direction away from the back frame, each of the tertiary tensioning assemblies being mounted on the back frame behind the seat portion of the seating assembly, each of the tertiary tensioning assemblies comprising a central cable, a pulley, and a spring coupled to the back frame; and a strap having free ends couplable to the primary hand grips for being moved in response to the forward motion of a chest of a user.

2. A seat mounted workout station system for mounting adjacent a seating assembly having a back portion with a forward support surface for supporting a user of the seating assembly, a seat portion coupled to the back portion adjacent a lower extent of the back portion with an upward support surface for supporting the user of the seating assembly, the back portion having a head section formed at an upper end of the back portion, the system comprising:

a frame mounted adjacent the back and seat portions of the seating assembly, the frame including a back frame being positioned behind the back portion of the seating assembly, a seat frame being positioned below the seat portion of the seating assembly;

a pair of primary hand grips mounted on the back frame at a position adapted to be located adjacent to the chest of the user supported by the back portion of the seating assembly, and a pair of primary tensioning assemblies, each primary tensioning assembly applying tension to one of the primary hand grips to resist pulling of the primary hand grip in a direction away from the back frame, each of the primary tensioning assemblies being mounted on the back frame behind the seat portion of the seating assembly;

a pair of secondary hand grips mounted on the seat frame at a position adapted to be located adjacent to the legs of the user supported by the seat portion of the seating assembly, and a pair of secondary tensioning assemblies, each secondary tensioning assembly applying tension to one of the secondary hand grips to resist pulling of the secondary hand grip in a direction away from the back frame, each of the secondary tensioning assemblies being mounted on the back frame behind the seat portion of the seating assembly;

a pair of tertiary hand grips mounted on the frame extensions of the back frame at a position adapted to be located adjacent to the head of the user supported by the back portion of the seating assembly, the tertiary hand grips being mounted above the primary hand grips on the back frame, and a pair of tertiary tensioning assemblies, each tertiary tensioning assembly applying tension to one of the tertiary hand grips to resist pulling of the tertiary hand grip in a direction away from the back frame, each of the tertiary tensioning assemblies being mounted on the back frame behind the seat portion of the seating assembly.

3. The system as set forth in claim 2 wherein the secondary hand grips rest on outboard ends of the seat portion of the seating assembly.

4. The system as set forth in claim 2 wherein the tertiary hand grips are situated on top of the back portion of the seating assembly.

5. The system as set forth in claim 4 wherein the frame includes a pair of frame extensions extending upwardly from an upper end of the back frame, and the tertiary hand grips are rested on the frame extensions extending upwardly from the back frame.

6. The system as set forth in claim 2 wherein the primary hand grips are situated at a central extent of the back portion of the seating assembly.

7. The system as set forth in claim 6 wherein the primary hand grips are rested on horizontal arms each extending forwardly from the back frame along an axis which is a normal to a plane in which the back frame resides.

8. The system as set forth in claim 5 and further including a strap couplable to the primary hand grips.

* * * * *